United States Patent [19]

Takimae

[11] Patent Number: 4,464,562

[45] Date of Patent: Aug. 7, 1984

[54] ELECTRIC CURLING-IRON WITH SPIRAL POLYGONAL HAIR ENGAGING EDGES

[76] Inventor: Toyosaku Takimae, 2-26, 2-chome, Takanawa, Minato-ku, Tokyo, Japan

[21] Appl. No.: 379,159

[22] Filed: May 17, 1982

[30] Foreign Application Priority Data

Oct. 16, 1981 [JP] Japan ..... 56-164088

[51] Int. Cl.[3] ..... A45D 1/12; H05B 3/00

[52] U.S. Cl. ..... 219/225; 132/31 R; 132/32 R; 132/37 R

[58] Field of Search ..... 219/222-226; 132/37 R, 37 A, 32 R, 32 B, 31 R, 33 R

[56] References Cited

U.S. PATENT DOCUMENTS

| | | | |
|---|---|---|---|
| 866,778 | 9/1907 | Eldridge | 132/37 R |
| 1,397,332 | 11/1921 | Russell | 132/32 B |
| 1,491,415 | 4/1924 | Pegelow | 219/225 X |
| 3,516,420 | 6/1970 | Porter | 219/225 X |

FOREIGN PATENT DOCUMENTS

| | | | |
|---|---|---|---|
| 1073699 | 1/1969 | Fed. Rep. of Germany | 132/32 R |
| 53-68383 | 6/1978 | Japan | 219/225 |

*Primary Examiner*—A. Bartis

*Attorney, Agent, or Firm*—Jordan B. Bierman; Linda Bierman; C. Cornell Remsen, Jr.

[57] ABSTRACT

An electric curling iron for producing a spiral curl giving the impression of a stream-like natural and soft wave is constructed in the form of a scissors having one blade comprising an electrically heated rod and the other blade comprising a clamp cooperating with the rod to press hair to be curled therebetween. The surface of the rod has a plurality of side by side spiral polygonal edges. The clamp is an arcuately shaped cover longitudinally coextensive with the rod and in contact with the polygonal edges thereby, leaving a free space between the clamp and heater rod for the escape of vapor. The arcuately shaped clamp may have a radius smaller than that of the rod and may be provided with a rubber cover. Since the edges are obliquely pressed against the hair during use possible hair damage by heat and pressure is reduced.

4 Claims, 3 Drawing Figures

ELECTRIC CURLING-IRON WITH SPIRAL POLYGONAL HAIR ENGAGING EDGES

BACKGROUND OF THE INVENTION

1. Field of the Invention

This invention relates to a hair-arranging electric curling-iron which can impart a natural shape to hair.

2. Description of the Prior Art

To wave hair, there has been heretofore proposed a method which comprises winding a part of the hair about a rod heated by electric heat, and provided with an edge having a polygonal section and a number of protrusions, and applying heat to the hair while applying tension thereto to bend the same. This method has become widespread even in barber shops for men.

In the above-described conventional hair-arranging electric curling-iron, the polygonal edge or a number of protrusions extend in a direction of the center line of the heating rod, and in operation, the iron or said rod is positioned horizontally, around which is wound the hair with the result that the obtained wave naturally extends in a horizontal direction, thus failing to obtain a natural and soft wave. In addition, hair is pressed and heated at right angles to the length thereof between the protrusions of the rod and a clamp for holding hair in a fashion of scissors corresponding thereto, as a result of which it poses the disadvantage that severe local pain may occur.

SUMMARY OF THE INVENTION

This invention provides a hair-arranging electric iron without suffering from the disadvantages noted above by the provision of an arrangement wherein an edge or protrusions on the rod are inclined with respect to a center line of the rod so as to form a spiral configuration.

That is, if the edge or protrusions on the rod are spirally provided, the edge or protrusions are thus obliquely pressed against the length of hair and thus the hair is not only curled within a plane including its length, but curled within a plane perpendicular to the length to form a spiral curl, thus producing an impression of a stream-like natural and soft wave.

In addition, since the protrusions are obliquely pressed against the hair, the part subjected to heat and pressure becomes longer than in the case where the protrusions are pressed at a right angle, and thus materially decreases damage such as cutting of the hair.

DETAILED DESCRIPTION OF THE PREFERRED EMBODIMENT

Figure 1:
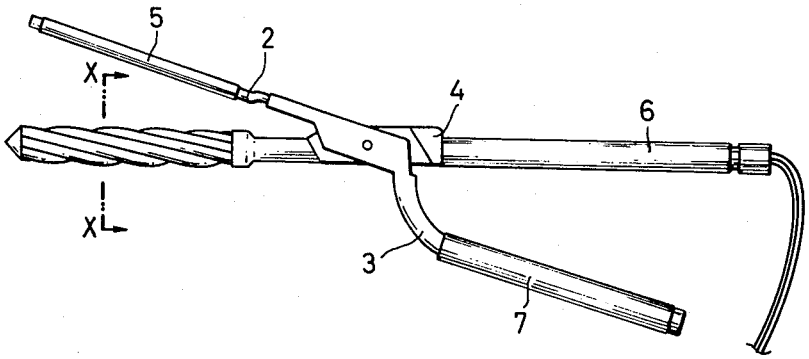
FIG. 1 is a side view of a preferred embodiment of a hair-arranging electric iron in accordance with the present invention.
Figure 2:
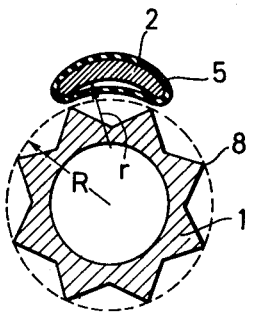
FIG. 2 is a cross-sectional view taken along line X—X of FIG. 2.

FIG. 1 shows one embodiment of a hair-arranging iron in accordance with the present invention, in which one portion 1 corresponding to a blade of the iron formed into scissors is called a rod which accommodates therein an electric heater device (not shown) as is known in the art. Reference numeral 2 designates a clamp, and hair is held and pressed between the clamp and the rod 1 by manipulating handles 3 and 4. In the iron according to the present invention, the concavity in the inner surface of the clamp has a section of radius r (FIG. 2) which is slightly smaller than radius R of the rod, and is covered with a rubber cover 5.

In the illustrated embodiment, the rod 1 is formed in a straight line fashion with respect to the handle, in which shape, when hair is wound round the rod, the rod 1 is readily stabilized in position. Thus, a failure wherein the hot rod 1 is erroneously pressed against the skin of a head is decreased. Both the handles 3 and 4 have rotatable holding tubes 6, 7 to facilitate winding of hair while rotating the iron within the palm.

The present invention is characterized in that as shown in FIG. 1, the polygonal edge or protrusion 8 formed on the surface of the rod 1 is not formed parallel to the center line of the rod but is formed spirally. With this inclination, a wave formed by the iron in accordance with the present invention is not a wave in a horizontal direction but a natural and soft wave, depending on the direction of spiral of the rod, the wave flows to the right if the spiral is wound rightwards whereas the wave flows to the left if the spiral is wound leftwards.

Figure 3:
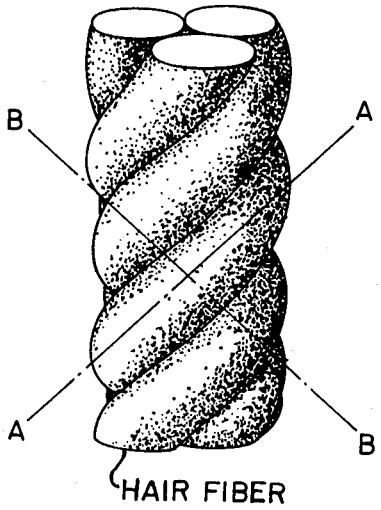
FIG. 3 is an enlarged view of a hair fiber.

Furthermore, since the edge or protrusion 8 of the rod 1 is pressed obliquely against the hair, damage to the hair, such as burn-off at the pressing portion, is materially reduced as compared with the prior art in which the edge or the like is pressed at a right angle. This effect is particularly conspicuous in the case when the edge or protrusion 8 on the rod is wound rightwards as shown as compared with the case it is wound leftwards. Hair fiber has a basic construction as shown in FIG. 3, three keratins having a spiral construction being intertwined. If the protrusion 8 of the rod 1 is wound rightwards, the same winding as the spiral of the keratin is obtained and therfore the protrusion is pressed in the direction of length A of keratin. It is assumed that said right-winding decreases damages of hair fiber as compared with the left-winding rod in which the protrusion is pressed in the direction B at a right angle to the keratin spiral.

In addition, if the radius r of the concavity in the inner surface of the glove is slightly smaller than the radius R of the rod 1, when hair is pressed by the rod 1 and clamp 2, a space is formed in a central portion therebetween with the result that hair is evenly pressed in the inner surface of the clamp and possible damage to the hair is further decreased. However, if the space is too small, both the side edges of the clamp touch hair the too hard, as a consequence of which the wave becomes unnatural.

In the event that the edge or protrusion 8 of the rod 1 extends in the direction of the center line of the rod, the specific edge or protrusion is opposed to the specific position of the clamp. Thus, when the opposed condition between the rod and the clamp becomes deviated due to a deviation in a mounting portion in the form of scissors or the like, it is immediately turned into a change in the pressing condition of hair. However, if the edge or protrusion 8 is spiral as in the iron of the present invention, a single edge or protrusion is to be pressed against the whole surface from right end to left end of the clamp and thus, an influence resulting from the deviation of the position of the rod and glove is minimized as compared with prior art articles.

In the present invention, by the provision of a simple construction in which the edge or protrusion on the rod is provided obliquely and spirally with respect to the center line of the rod, it is possible to provide a natural hair arrangement including a lateral wave that has been heretofore impossible, the damage of hair may be materially decreased, and hair arrangement is not influenced by the deviation of the iron. Thus, the present invention may offer extremely improved effects, as just mentioned.

What is claimed is:

1. In a curling iron for hair of the type constructed in the form of a scissors having one blade comprising an electrically heated rod and the other blade in the form of a clamp cooperating with said rod to press hair therebetween, the improvement comprising forming the surface of said rod with a plurality of side by side spiral polygonal edges, and said clamp is an arcuately shaped cover longitudinally coextensive with said rod and in contact with the edges of said rod, leaving a free space formed between said clamp and said rod when the hair is pressed between them.

2. In a curling iron according to claim 1 in which the improvement comprises forming said polygonal edges with a rightward spiral.

3. In a curling iron according to claim 1 or 2 in which said improvement comprises forming said arcuately shaped clamp with a radius smaller than the radius of said rod.

4. In a curling iron according to claim 3, in which said improvment includes a rubber cover about said arcuately shaped clamp.

* * * * *